United States Patent [19]

Wyslotsky

[11] 4,136,504

[45] Jan. 30, 1979

[54] SLICING METHOD

[76] Inventor: Ihor Wyslotsky, 3311 Montmarte, Hazelcrest, Ill. 60429

[21] Appl. No.: 823,537

[22] Filed: Aug. 10, 1977

Related U.S. Application Data

[63] Continuation-in-part of Ser. No. 721,953, Sep. 10, 1976, abandoned.

[51] Int. Cl.[2] ..... B65B 63/00; B26D 4/34; B26D 5/34

[52] U.S. Cl. ..... 53/435; 53/502; 53/503; 53/504; 83/13; 83/77; 83/365; 177/50

[58] Field of Search ..... 53/23, 123, 59, 60, 53/62; 144/312; 83/13, 73, 77, 358, 359, 365, 360, 371; 177/50

[56] References Cited

U.S. PATENT DOCUMENTS

| | | | |
|---|---|---|---|
| 3,099,304 | 7/1963 | Monsees et al. | 177/121 |
| 3,105,533 | 10/1963 | Hensgen et al. | 83/77 X |
| 3,142,323 | 7/1964 | Metzler | 83/73 |
| 3,200,864 | 8/1965 | Gillman | 83/73 |
| 3,508,591 | 4/1970 | Johnson et al. | 83/13 |
| 3,556,235 | 1/1971 | Allen et al. | 177/50 |
| 3,599,689 | 8/1971 | Grant et al. | 83/73 X |
| 3,664,397 | 5/1972 | Raye et al. | 83/73 X |
| 3,846,958 | 11/1974 | Divan | 53/59 W |
| 3,893,281 | 7/1975 | Smithers | 53/123 |
| 3,905,259 | 9/1975 | Spooner | 83/77 |
| 3,995,517 | 12/1976 | Smith | 83/13 |

*Primary Examiner*—Horace M. Culver
*Attorney, Agent, or Firm*—Cook, Wetzel & Egan, Ltd

[57] ABSTRACT

An improved method for automatically producing a selected weight draft of sliced product from a workpiece in substantially uniform weight slices and in an integral number of slices.

17 Claims, 3 Drawing Figures

SLICING METHOD

BACKGROUND OF THE INVENTION

This application is a continuation-in-part of my prior application, Ser. No. 721,953, filed on Sept. 10, 1976, and now abandoned.

The present invention relates generally to methods for slicing a workpiece, and more particularly to improved methods for automatically and accurately producing a selected weight draft of substantially uniform weight slices of a workpiece of variable density, such as bacon, in a selected integral number of such slices per draft, and for automatically grading the slices in accordance with predetermined standards.

Prior art methods for slicing, especially in the food and meat industries, have presented certain difficulties. Governmental regulations relative to the weighing and labeling of food products in general have been especially stringent. Additional difficulties in meeting those standards are encountered when the product is sold as a pre-sliced product. Further difficulties regarding consumer acceptance have also been presented by prior art methods of slicing.

In order to meet present Governmental regulatory standards on the weighing and labeling of food products in general, it is necessary that there be but little error between the actual weight of the product sold and the labeled weight. In order to meet these regulations, expensive hand labor ofttimes has been necessary. Where hand labor has been avoided, precision packaging and labeling machinery have been necessary, which equipment is expensive both in initial purchase and in maintenance.

In an attempt to solve the accuracy-in-labeling problem, some producers have packaged the product in arbitrary weights, then weighing and labeling the product in fractions of a unit weight. However, that approach has been less than satisfactory in view of present marketing trends relative to consumer acceptance.

Where the product to be sold is sliced prior to packaging, producers and/or packers have been faced with yet additional difficulties in both accurately weighing and labeling the quantity of food in the packages sold, and in simultaneously presenting a commercialy acceptable product. Some methods of mechanized weighing and labeling of sliced product have been dictated by the fact that prior art weighing methods have not been sufficiently fast to keep pace with other of the machinery on a processing line. In some of those prior art methods, rather than weighing individual slices a partial draft is weighed and the weight correction necessary to bring the completed draft to the desired unit weight is made in the last few slices. This has resulted in substantially non-uniform slices and/or a non-standard number of slices per unit weight, which has been less than desirable to the consumer.

Another approach has been to advance the workpiece at a uniform rate, but to vary the speed of the rotary knife blade used for slicing. Still other approaches have utilized mechanical, finger-like sensors to attempt to fix prospective slice thickness by determining the contour of the workpiece. These prior art approaches have frequently resulted in uneconomical error in draft weights, less than desired uniformity in individual slices, and reduced consumer acceptance.

Another attempted approach has been to utilize a continuously advancing workpiece feeder on the slicer wherein the successive thicknesses of the slices is controlled by varying the rate of advance. U.S. Pat. No. 3,508,591 to Johnson et al. discloses and claims such a system. In such continuous advance systems wherein the slice thickness is sought to be controlled by varying the rate of the continuous advance, the rate of advance may be in constant flux from slice to slice. Accordingly, equipment functioning by such principles is inherently limited in accuracy, in speed of production, and in freedom from constant maintenance and adjustment.

In contrast, the benefits of improved methods utilizing principles of incremental advance are manifest. The advantageous results of such improved methods are found in the combination of increased speed of production and greater accuracy. Yet further, the relatively less complex method of workpiece advance permits a substantial reduction in maintenance and adjustment costs.

Most fundamentally, none of the prior art systems have presented both means for rapid production of substantially uniform slices in a selected weight draft and means for automatic grading of the resulting sliced product. This additional difficulty of prior art systems is materially alleviated by the improved methods of the present invention by providing means for detecting the ratio of fat to lean in a bacon slice, and also the presence of voids, and of lymph gland and/or mammary gland tissues and/or isolated bits, which would lower the grade or quality of the sliced bacon product.

Accordingly, in view of the difficulties associated with prior art systems, it is an object of the present invention to provide improved methods for automatically producing from a workpiece of variable density, such as bacon, a selected weight draft of substantially uniform slices by means of incrementally advancing the workpiece for slicing, whereby increased speed of production and greater accuracy in weight are obtained.

It is an additional object of the present invention to provide improved methods for automatically grading such sliced bacon wherein the presence in slices of an excessive fat to lean ratio, or defeats, such as voids, lynph glands and/or mammary gland tissues and/or isolated bits, may be detected and such slices may be shunted aside for packaging in one or more separate grades.

Other objects and advantages will become apparent from the following detailed description of the improved methods of the present invention, which detailed description is to be taken in conjunction with the accompanying drawings.

SUMMARY OF THE INVENTION

The present invention is directed to improved methods for automatically slicing a workpiece of variable density, such as bacon, into a draft of a given integral number of substantially uniform slices of a preferred weight. One embodiment of the improved methods of the present invention is practiced by cutting a first slice and then detecting an indicium of the weight of such slice. The weight for the next succeeding slice is determined therefrom and the workpiece is incrementally advanced for further slicing in accordance therewith to produce a second slice having a weight which will bring the average weight of the slices in the draft substantially to the preferred weight of the standard, uniform weight slice. Those steps are repeated until a selected number of such slices to make up the selected draft has been cut. In such fashion, the method of the present invention provides a feedback after each slice to progressively correct the respective increments of workpiece advance to produce substantially uniform slices of an accurate, preferred weight.

In an alternative preferred embodiment of the improved methods of the present invention an integral number of slices per each unit weight draft is selected, thereby determining the preferred weight for each slice. Thereafter, a first indicium of weight is detected from the workpiece face, such as preferably the cross-section area thereof, and the slice thickness which will produce a first slice of substantially the preferred weight is cut upon incremental advance of the workpiece in such determined amount. Thereafter, a second indicium of weight, such as preferably the density of the first slice as cut, is detected. Such second indicium of weight is then utilized in conjunction with a first indicium of weight determined for the next succeeding slice to determine from both such indicia the thickness which will produce a next succeeding slice of substantially the preferred weight. The above steps of incrementally advancing, cutting, and detecting the first and second indicia of weight are repeated until the required number of slices has been cut.

In a further preferred embodiment of such improved methods of slicing, each slice is scanned in at least two selected electromagnetic regions, such as red and yellow light. The reflected light from the slice is then detected in an array of discrete points for determining the fat to lean ratio, the presence of voids, and the presence of lymph and/or mammary glands and/or isolated bits. Such data is then utilized for grading the individual slices prior to packaging.

DETAILED DESCRIPTION OF PREFERRED EMBODIMENTS

Figure 1:
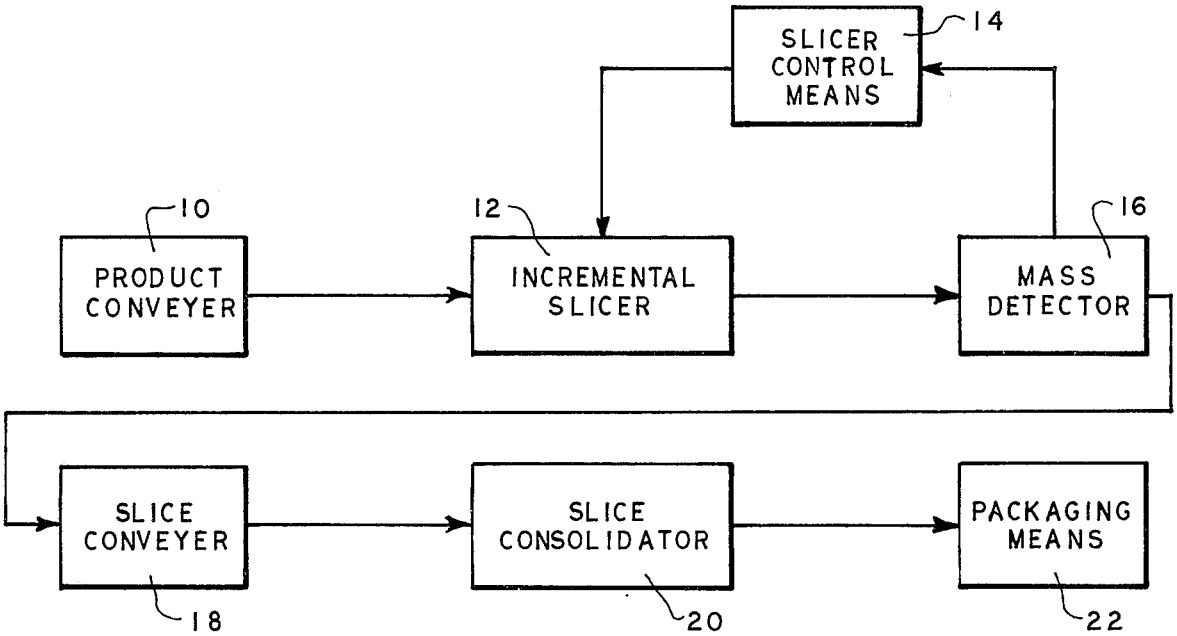
FIG. 1 is a block diagram showing, inter alia, the slicing and weight detecting steps connected by a feedback control.

The present invention is directed to improved methods for automatically producing a draft of slices, each having a substantially uniform weight, from a workpiece of variable density, such as bacon, wherein such draft of slices is composed of a selected integral number of slices per draft.

One preferred method comprises selecting the number of and the preferred weight for such uniform weight slices to make up the draft. The product is then advanced for cutting a first product slice. After such first slice has been cut, an indicium of its weight is detected. From that indicium of weight, the weight for a second slice is determined so as to bring the average weight of the slices substantially to the preferred slice weight. In accordance with such weight determination, the product is incrementally advanced to cut a second slice. The above sequence of indicium of weight detection, incremental advance in accordance therewith and cutting of subsequent slices is repeated until the selected number of slices per draft has been reached.

In another preferred embodiment of the improved methods of the present invention for automatically producing a selected weight draft of sliced product from a variable density workpiece, and in substantially uniform weight slices, an integral number of slices for each draft is selected, thereby determining the preferred weight for each slice. Thereafter, a first indicium of weight, such as preferably the cross-sectional area of the workpiece face, is detected prior to slicing. An average density typical for the particular workpiece may be assumed. From the assumed density and the measured cross-sectional area of the workpiece face, the slice thickness which will produce a first slice of substantially the preferred weight is fixedly determined. Next, the workpiece is incrementally advanced the determined thickness, and the first slice is cut from the workpiece.

A second indicium of weight, such as the actual density of the slice as cut, is detected. Such actual density may be determined by weighing the slice, and given the cross-sectional area as previously measured and the incremental advance producing such slice, the actual density of the slice is fixed. That actual or measured density information may then be fed back to use in conjunction with subsequent cross-sectional area measurements of subsequent slices, to determine the incremental advance necessary to produce a slice of substantially the preferred weight. The density of more than one slice may be measured at one time to minimize transient error. In essence, the measured density for a slice is utilized to correct any error in the previously assumed density. These steps of incrementally advancing, cutting, and detecting the first and second indicia of weight are then repeated until the selected number of slices to make up the draft has been cut. The slices are then conveyed away from the slicing station for packaging.

It is contemplated as being within the scope of the present invention that the first indicium of weight for the product slices, as well as the presence of an excessive fat to lean ratio and/or various product defects, may be detected by any suitable means, such as for example by electronic means in the form of a photoscanning device. A digital line scan camera or an emitter source and receiver for the reflected light, as are more fully described hereinafter, may be utilized. Also, the actual weight of the slices may be detected by weighing on an automated scale.

Further, in the present invention after a draft of slices has been cut, the slices may be conveyed away from the weight detecting means, consolidated for packaging, and packaged in accordance with the grade determined by photoscanning. In alternative embodiments, the incremental advance of the product for cutting may comprise relative motion between the product and the means for cutting. Although the improved methods hereof are of great applicability in the automatic slicing and grading of bacon, it is contemplated as being within the scope of the present invention to utilize such improved methods in conjunction with any workpiece having a variable density.

It is also within the scope of the present invention to provide a method of slicing wherein it is assumed that the contours and density of the workpiece are substantially uniform in sequential slices. In that instance the incremental advance for a next succeeding slice ($i_2$) is determined from the incremental advance ($i_1$) of the slice immediately prior and the weight detected for such prior slice ($w_1$), according to the following formula:

$$e_2 = i_1 [2X/w_1 - 1],$$

wherein X equals selected optimum weight for the uniform slice and wherein $2X > w_1$.

Figure 2:
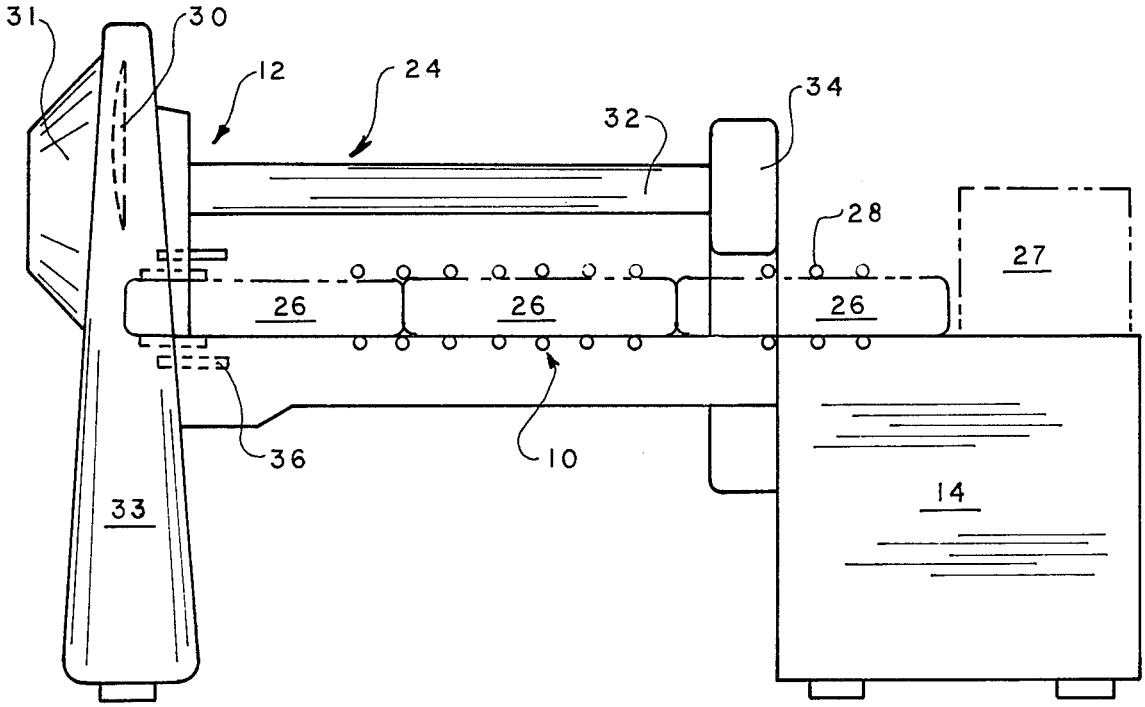
FIG. 2 is a schematic side elevational view of an embodiment of an incremental slicer apparatus such as may be used in practicing the improved methods of the present invention.

Referring now to the drawing and FIGS. 1 and 2 in particular wherein common numerals are utilized for common elements, the workpiece to be sliced is conveyed on a workpiece conveyor symbolized by schematic conveyer 10 to an incremental slicer station 12. The workpiece may preferably comprise palletted, pressed bellies which are delivered to slicer station 12 at a specified slicing temperature. The bellies may be destined for processing into several grades, as set forth more fully hereinbelow, although the simultaneous processing of a single grade is also contemplated in certain embodiments. The bellies may be loaded onto conveyer 10 continuously.

Prior to slicing, slicer control means 14 is programmed with a selected optimum weight for a substantially uniform weight slice and is also programmed with a selected integral number of such uniform weight slices to make up the desired draft. For example, one ounce slices may be selected as the uniform weight slice and fifteen to twenty-two, preferably sixteen, such slices may be selected for a draft weighing one pound. The product is then advanced on the slicer and a first slice is cut. The first workpiece advance may be accomplished by setting the advancer to perform a selected incremental advance between certain minimum and maximum limits, or such first advance may be manually done. An indicium of weight of the first such slice is then detected at a mass detector station 16 and transmitted to the control means 14 for determining the required incremental advance for the next succeeding slice. Such determined incremental advance is then transmitted from the control means 14 to the incremental advancer on slicer 12 in an amount sufficient to produce a second slice to have a weight which will bring the average weight of the slices thus far cut to substantially the weight of the selected preferred weight slice. Such second slice is then cut and the above sequence of incremental advance, detecting of an indicium of weight and determination of the next required weight (and hence incremental advance necessary to produce such weight) is repeated until the selected number of slices in the draft is reached.

After the weight of each slice is detected by the mass detector 16, it is transmitted along a slice conveyer 18 to a slice consolidator station 20 where the selected number of slices in a draft is consolidated to make up a draft. The consolidated draft is then conveyed to a packaging station 22, where it is packaged in material suitable to contain the particular sliced product, for example, plastic film as in the case of slices of food products such as bacon.

Alternatively, after the preferred number of slices per draft has been selected, thereby also fixing the required weight per slice for a given weight draft, the cross-sectional area of the end face of the workpiece may be measured preferably by photoscanning techniques. Based on an assumed average density for the particular workpiece being sliced and on such measured cross-sectional area, the thickness to produce a slice of the selected weight is calculated by the control means 14. The workpiece is then incrementally advanced on slicer 12 to the required thickness, and the slice is cut. The slice is then conveyed on conveyer 18 to mass detector 16, where its weight is measured. From the measured weight, given the above thickness and measured cross-sectional area determining the volume of the slice, the actual density of the slice, as cut, is measured. Alternatively, the density may be measured for several slices to avoid transient error. That measured density may then be fed back by control means 14 for correction of the previously assumed density. The above steps are then repeated until the selected number of slices in the draft are cut.

FIG. 2 illustrates schematically one embodiment of an incremental slicer apparatus, generally designated as 24, which is suitable for use in the methods of the present invention. Other forms of incremental slicer may be used, as long as the slicer functions to advance the product 26 in accurately controllable increments, preferably on the order of $1/1000^{th}$ of an inch. In incremental slicer 24, workpiece slabs 26, such as bellies, are transmitted from a loading station 27 along a suitable product conveyer, generally designated as 10, such as for example a conveyer comprising rollers 28, to the incremental slicer, generally designated as 12. The slicing blade 30, having a slicer head assembly 31 and a slicer head support 33, is driven by a drive shaft 32 which is powered by a drive unit 34 connected to a source of power (not shown). Prior to the cutting of each slice, the feed mechanism 36 (shown schematically) advances workpiece 26 a distance determined by the control unit 14. The slicing blade 30 then engages the workpiece 26 to cut a slice from the exposed end thereof, the thickness of which slice is determined by the amount of the corresponding incremental advance. The product slice is then conveyed from the incremental slicer apparatus 12 by a conveyer (not shown) to a mass detector means 16.

Figure 3:
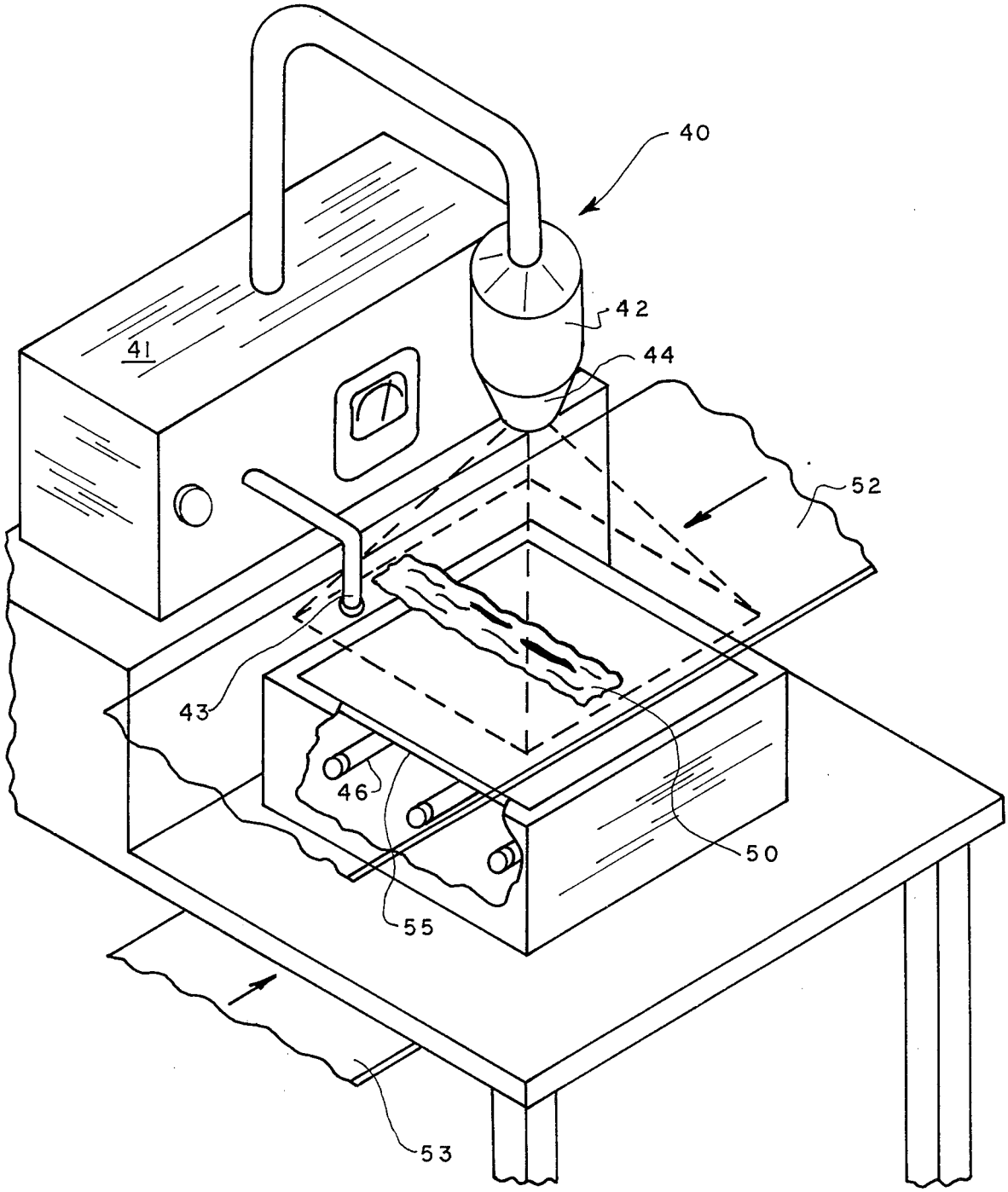
FIG. 3 is a schematic diagram showing one embodiment wherein a product slice is scanned by photoscanner means for detecting the fat to lean ratio, voids, and/or the presence of lymph and/or mammary glands and/or isolated bits.

One form of such mass or weight detection means is illustrated in FIG. 3 as a photoscanning apparatus 40. The photoscanning camera 40 is schematically shown feeding into a photoscanning apparatus control and data processing unit 41, which has a scanner head 42 and an edge sensor 43.

The operation of such photoscanning apparatus 40 may be regarded as being analogous to that of a photographic camera, wherein the film plane has been replaced by a linear array of tiny photodiodes. The field of view of the camera may be controlled depending on the work distance and the choice of lenses 44. In the embodiment shown in FIG. 3, lens 44 is selected to scan a field large enough to view an entire slice. In either such instance, the field of view is imaged by the lens 44 onto the photodiode array, which is scanned electronically to produce a train of analog electrical pulses each having an amplitude proportional to the light intensity on the corresponding photodiode. The light therefor is produced by any suitable illumination source 46 which may be located on an opposite side of the product slice 50 being scanned. Such product slice 50 may be conveyed on a substantially transparent belt conveyer 52, showing the return belt portion at 53 and a diffusing glass 55 disposed therebeneath in alternative embodiments, such that light from illumination source 46 may be transmitted to photoscanning camera 40 in areas where no product slice 50 intervenes.

Product slice 50 is supplied to belt conveyer 52 from the incremental slicer 12 for detection of an indicia of mass, such as for example its cross-sectional area. By programming the control means 14 with data for an assumed average density of the particular workpiece, and having stored and recalled the amount of the incremental advance which produced the given slice, an indicium of the weight of the slice may be computed for feedback to control the thickness of the next successive slice.

In an alternative method of the present invention, the indicium of weight of the product slices may be detected prior to slicing each slice. Preferred means for carrying out such alternative embodiment includes a light emitter source in the form of a scanner head. The photoscanning apparatus may have single or plural heads for scanning in more than one spectral region where detection of the fat to lean ratio, defects and/or isolated bits is desired for grading the slices scanned. Each scanner head comprises a multitude of photoelectric bundles arranged side-by-side at increments preferably less than approximately 1/16 inches and disposed adjacent the exposed end surface of the workpiece to emit light having a collective beam of sufficient size to contact such entire exposed end surface of the workpiece. A polarizing means such as a collimater may be disposed between the light emitter source and the workpiece end surface so that only parallel light may be transmitted to the workpiece end surface. The portion of the emitted light which strikes the workpiece end surface is reflected through polarizing means and received by a reflected light receiver. The receiver may have multiple heads for receiving radiation of different wave lengths. By comparing the emitted light with the reflected light for each such photoelectric bundle and summing over the entire scanner head, the cross sectional area of the workpiece end surface is determined. From such area data, and given the assumed or measured density of the workpiece to be sliced and the uniform weight desired, the control means establishes the thickness of slice required to yield such selected uniform slice weight. The workpiece is then incrementally advanced the required distance and the uniform weight slice is cut and the method is repeated until, as above, the selected number of slices in the draft has been reached, whereupon the slices may be consolidated for packaging.

In a preferred alternative embodiment of the present invention, the presence of defects, as well as the fat to lean ratio, may be detected for grading. Although such data may be determined by a variety of different means, one means for carrying out the methods comprises an electrical optical system having two sensor heads, of the type shown in FIG. 3 for example, each connected to the control means 14. Each head scans with a different color light, for example red and yellow. When two such sensor heads are utilized for determining the cross-sectional area of the workpiece face, the system has the additional capability of detecting data useful for grading the slice when cut.

Each sensor head contains a central illuminating source and preferably four photosensitive detector arrays, each containing a plurality of detector elements.

A central illumination source is preferred in order to prevent unwanted reflection from the workpiece. Unwanted reflection from the internal parts of the apparatus may be obviated by using blackened surfaces. A flow of compressed air is preferably used to clean up the cutting area between the cutting of slices to further reduce unwanted reflection.

The use of such multiple detector arrays provides for an optimal aspect ratio of approximately 6:1, high accuracy on the order of 0.1 percent area resolution, the detection of small defects or voids of larger than ⅛ inch in diameter, two color discrimination as to defects, and rejection of isolated reflection from scraps. The tabulation hereinbelow illustrates the four types of tissue and background reflection detected by the electrical optical system.

| | | AVERAGE REFLECTIVITY | | | |
|---|---|---|---|---|---|
| | | RED | YELLOW | R + Y | R − Y |
| A. | Lean | 0.30 | 0.15 | 0.45 | 0.15 |
| B. | Fat | 0.50 | 0.50 | 1.00 | 0 |
| C. | Background | Low | Low | Low | Low |
| D. | Lymph Gland | 0.20 | 0.20 | 0.40 | 0 |
| E. | Mammary | 0.20 | 0.15 | 0.35 | 0.05 |

By comparing the reflectivity outputs of two pairs of arrays, point by point, in the selected spectral regions, such as red and yellow light, it can be reliably determined whether each point on the array corresponds to fat, lean, background, lymph gland or mammary gland tissue. Comparison with selected standards thus yields both grading and rejection information.

Although preferred embodiments have been shown and described, the particular means used to detect an indicia of the slice weight is not critical to the method of the present invention, and other alternative means, such as for example, an electronic scale may be used.

The basic and novel characteristics of the improved slicing method and apparatus of the present invention and the attending advantages thereof will be readily understood from the foregoing disclosure by those skilled in the art. It will become readily apparent therefrom that various changes and modifications may be made in the form, construction and arrangement of the method and apparatus set forth hereinabove without departing from the spirit and scope of the invention. Accordingly, the preferred embodiments of the present invention set forth hereinabove are not intended to limit such spirit and scope in any way.

What is claimed is:

1. An improved method of automatically producing a selected weight draft of sliced product from a workpiece of variable density in substantially uniform weight slices and in an integral number of slices, the selected weight draft having a first slice and at least one succeeding slice, said method comprising:

selecting an integral number of slices for each draft and thereby determining the preferred weight for each slice;

detecting from the workpiece a first indicium of weight for the first slice and determining therefrom the slice thickness which will produce a first slice of substantially the preferred weight;

incrementally advancing the workpiece the determined thickness;

cutting the first slice of the determined thickness from the workpiece;

detecting from the first slice as cut a second indicium of weight;

detecting from the workpiece face the first indicium of weight for a next succeeding slice and determining therefrom, and from the second indicium of weight for the first slice, the thickness which will produce a next succeeding slice of substantially the preferred weight;

repeating the steps of incrementally advancing, cutting, and said detecting the first and second indicia of weight until the selected integral number of slices has been cut; and conveying the slices away.

2. The improved method of claim 1 wherein the first indicium of weight detected is the cross-sectional area of the workpiece face.

3. The improved method of claim 2 wherein the second indicium of weight detected is the measured density of the slice as cut.

4. The improved method of claim 3 further comprising assuming an average density for the workpiece prior to the initial incremental advance for cutting, which assumed average density is corrected for each subsequent slice by feeding back the measured density of the immediately prior slice.

5. The improved method of claim 4 wherein the measured density fed back for correcting the assumed density is the mean of more than one slice as cut whereby transient errors in measured density are minimized.

6. The improved method of claim 1 wherein the workpiece is a slab of bacon containing volumes of fat and lean, the method further comprising:

determining for each slice the ratio of fat to lean on the workpiece face;

selecting maximum and minimum limits for such ratio of fat to lean;

consolidating drafts of slices having a fat to lean ratio within the selected limits for packaging as a first grade; and consolidating drafts of slices having a ratio of fat to lean outside the selected limits for packaging in at least one separate grade.

7. The improved method of claim 6 wherein determining the ratio of fat to lean comprises:

emitting electromagnetic radiation of at least two wavelengths onto a selected surface of the bacon workpiece;

reflecting the radiation from the selected bacon surface;

receiving the reflected radiation from such selected bacon surface in an array of discrete points; and comparing against selected standards the reflectivity of radiation for each wavelength at each discrete point in the array, whereby it is determined whether each discrete point in the array represents fat or lean.

8. The method of claim 1 wherein the workpiece is a slab of bacon and has one or more defects, selected from the group consisting of lymph glands, voids and isolated bits, the improved method further comprising:

detecting the presence of said defects for each slice; and packaging in at least one separate grade slices having such defects.

9. The improved method of claim 8 wherein detecting the presence of defects comprises:

emitting electromagnetic radiation of at least two wavelengths onto a selected surface of the bacon workpiece;

reflecting the radiation from the selected workpiece surface;

receiving the reflected radiation from such selected bacon surface in an array of discrete points; and comparing against selected standards the reflectivity of radiation for each wavelength at each discrete point in the array, whereby it is determined whether each point in the array represents a particular defect.

10. The improved method of claim 9 wherein such comparing of the reflectivity of radiation includes adding and subtracting for each discrete point in the array respective received reflectivities of the different wavelengths of electromagnetic radiation.

11. An improved method of automatically producing a selected weight draft of sliced product from a workpiece in substantially uniform weight slices and in an integral number of slices, the selected weight draft having a first slice and at least one succeeding slice, said method comprising:

selecting an integral number of slices for each draft and thereby determining the preferred weight for each slice;

cutting the first slice from the workpiece;

detecting at least one indicium of the weight for the first slice and determining from that detection the weight for the next succeeding slice such that the mean weight of the sliced product, including the next succeeding slice, will be substantially the preferred slice weight;

thereafter for each next succeeding slice in the selected integral number of slices, incrementally advancing the workpiece for cutting the next succeeding slice in accordance with the weight determination;

detecting at least one indicium of the weight for the next succeeding slice; and determining from that detection the weight for the yet next succeeding slice such that the mean weight of the sliced product including the yet next succeeding slice, will be substantially the preferred slice weight.

12. The method of claim 11 further comprising selecting, between maximum and minimum limits, an incremental advance of workpiece prior to cutting the first slice.

13. The method of claim 11 further comprising conveying said slices away from said detecting means.

14. The method of claim 11 further comprising consolidating the slices in the draft.

15. The method of claim 11 further comprising packaging such draft of slices.

16. The method of claim 11 wherein said incremental advancing of the product for cutting comprises relative motion between the workpiece and the means for cutting.

17. The method of claim 11 wherein said incremental advance for such next succeeding slice ($i_2$) is in an amount proportional to the first incremental advance ($i_1$) and the indicia of weight detected for such first slice ($W_1$), according to the following formula:

$$i_2 = i_1 [2X/W_1 - 1],$$

Wherein X equals the selected preferred weight for such uniform slice and wherein $2X > W_1$.

* * * * *

UNITED STATES PATENT AND TRADEMARK OFFICE

CERTIFICATE OF CORRECTION

PATENT NO. : 4,136,504

DATED : January 30, 1979

INVENTOR(S) : Ihor Wyslotsky

It is certified that error appears in the above-identified patent and that said Letters Patent are hereby corrected as shown below:

Column 1, line 45, "commercialy" should be -- commercially --.

Column 2, line 42, "lynph" should be -- lymph --.

Column 5, line 5 "$e_2$" should be -- $i_2$ --.

Signed and Sealed this

*First* Day of *May 1979*

[SEAL]

*Attest:*

RUTH C. MASON
*Attesting Officer*

DONALD W. BANNER
*Commissioner of Patents and Trademarks*